United States Patent [19]

Spannuth et al.

[11] Patent Number: 4,718,978

[45] Date of Patent: Jan. 12, 1988

[54] SPENT PULPING LIQUOR RECOVERY PROCESS

[75] Inventors: Robert J. Spannuth, Washougal; Robert A. Damon, Vancouver, both of Wash.

[73] Assignee: James River Corporation of Nevada, San Francisco, Calif.

[21] Appl. No.: 798,709

[22] Filed: Nov. 15, 1985

Related U.S. Application Data

[63] Continuation of Ser. No. 592,032, Mar. 21, 1984, abandoned.

[51] Int. Cl.[4] ..... D21C 11/10; D21C 11/12; D21C 11/14

[52] U.S. Cl. ..... 162/29; 162/30.1; 162/30.11; 162/31; 162/47; 159/47.3; 423/207; 423/DIG. 3

[58] Field of Search ..... 162/30.1, 30.11, 31, 162/47, 16, 29; 423/514, 206 R, 207, DIG. 3; 154/47.3

[56] References Cited

U.S. PATENT DOCUMENTS

| | | | |
|---|---|---|---|
| 3,714,911 | 2/1973 | Pradt | 162/30.11 |
| 3,873,414 | 3/1975 | Rocher et al. | 162/30.1 |
| 4,441,959 | 4/1984 | Empie, Jr. et al. | 162/30.1 |

OTHER PUBLICATIONS

Grace "The Impact of Black Liquor Oxidation on Total Energy"; vol. 60, No. 11, Nov. 1977 *Tappl;* pp. 132–135.

Grace "Increasing Recovery Boiler Throughput"; *Tappl,* vol. 67, No. 11, pp. 52–58.

*Primary Examiner*—Steve Alvo

*Attorney, Agent, or Firm*—Jerome S. Marger; Stanley M. Teigland

[57] ABSTRACT

A partially-oxidized spent pulping liquor is produced which is added to unoxidized strong spent pulping liquor prior, during, or subsequent to concentration to form a novel partially-oxidized, concentrated, high total solids spent pulping liquor. This novel, partially-oxidized, concentrated spent liquor is capable of being combusted in a spent liquor recovery furnace without the addition of auxiliary heating fuel with a resultant increase in the effective capacity of that furnace.

10 Claims, 3 Drawing Figures

WSL— WEAK SPENT PULPING LIQUOR
SSL— STRONG SPENT PULPING LIQUOR
CPL— CONCENTRATED PRODUCT SPENT PULPING LIQUOR

WSL- WEAK SPENT PULPING LIQUOR
SSL- STRONG SPENT PULPING LIQUOR
FSL- FEED SPENT PULPING LIQUOR
OESL- PARTIALLY -OXIDIZED, EVAPORATED SPENT PULPING LIQUOR
CPSL- CONCENTRATED PRODUCT SPENT PULPING LIQUOR
CSL- PARTIALLY -OXIDIZED, CONCENTRATED SPENT PULPING LIQUOR

SPENT PULPING LIQUOR RECOVERY PROCESS

This is a continuation of co-pending application Ser. No. 592,032 filed on Mar. 21, 1984, now abandoned.

BACKGROUND OF THE INVENTION

The present invention is directed to a spent pulping liquor recovery process in which the effective capacity of the spent pulping liquor recovery furnace is significantly increased by adding to an unoxidized strong spent pulping liquor stream, prior or subsequent to concentration thereof, a predetermined amount of partially oxidized, evaporated spent pulping liquor having a substantially reduced heating value. The partially-oxidized, concentrated spent pulping liquor formed thereby is capable of being combusted in the furnace without the addition of auxiliary heating fuel.

In conventional pulping of lignocellulose employing a chemical pulping liquor, as schematically depicted in FIG. 1, weak spent pulping liquor denoted "WSL" (total solids of about 15–20% for alkaline weak pulping liquor), containing various by-product materials, is formed during the pulping operations. These by-product materials include inorganic material such as pulping chemicals, and organic materials such as lignocellulosic derivative compounds produced during alkaline pulping. The weak spent pulping liquor stream is evaporated to produce a strong spent pulping liquor designated "SSL" (45–50% by weight total solids), and is subsequently concentrated to a high total solids level of about 60–70% by weight. The concentrated spent pulpihg liquor product (CPSL) is then fired in a conventional recovery furnace so that the organic material is combusted, and the inorganic material and the heat of combustion are largely recovered.

Many commercial pulping facilities are limited in their pulp output because they are operating at the maximum capacity of their recovery furnace to combust spent pulping liquor. However, if this maximum capacity is exceeded, an elevated temperature profile will exist throughout the recovery furnace which will fuse entrained inorganic material present in the flue gas and cause fireside plugging of the recovery furnace convective sections. Therefore, if this total combustive heat release per unit of pulp production in recovery limited furnaces were significantly reduced, the pulp production rate could be increased.

If the spent pulping liquor introduced into the furnace can be modified so that the total heat released therein is lowered, firing of additional spent pulping liquor can result. This reduction in total heat release can be accomplished by lowering the heating value of the spent pulping liquor introduced into the furnace. The heating value is defined as energy evolved during combustion. In one approach, organic materials in the respective weak or strong spent pulping liquor streams are oxidized using air and/or oxygen to decrease the heating value thereof.

Various treatment systems have been employed by the prior art in an attempt to oxidize spent liquor to various extents. In U.S. Pat. No. 3,714,911, the entire weak spent liquor stream is subjected to wet air oxidation wherein two pounds of water per pound of air is evaporated prior to combustion in a recovery furnace. Although this is said to eliminate the need for multi-effect evaporation of the partially-oxidized spent pulping liquor, it actually produces a material having a lower heating value than the minimum value required for supporting combustion in a recovery furnace without the addition of auxiliary fuel.

Other attempts to oxidize spent pulping liquor include mild wet air oxidation, and oxidation with molecular oxygen, of sodium sulfide in the spent pulping liquor to sodium thiosulfate for odor control. See U.S. Pat. Nos. 3,709,975; 3,873,414; 4,073,727; 3,549,314; and 3,567,400.

In a process designed to eliminate the need for a recovery furnace, substantially all of the heating value of the spent pulping liquor is removed by complete flameless oxidation of all of the inorganic and organic materials present therein. See U.S. Pat. Nos. 2,824,058 and 2,903,425.

When an entire weak or strong spent liquor stream is oxidized so that its heating value is substantially reduced, and thus oxidized liquor is ultimately concentrated to the requisite level for introducing same into the recovery furnace, the liquor viscosity thereof will be increased to such an extent that it will not flow, and in some cases will actually be solidified. The above oxidation of weak black liquor has the further drawback of fouling the multiple-effect evaporators and causing excess foaming therein during the formation of strong black liquor.

SUMMARY OF THE INVENTION

In the spent liquor recovery process of this invention, a partially-oxidized, evaporated spent pulping liquor (OESL) is produced. By adding OESL to either unoxidized strong spent pulping liquor and then concentrating same, or directly to an unoxidized concentrated spent pulping liquor per se, a novel partially-oxidized high total solids, concentrated high total solids spent pulping liquor (OCSL) can be produced which, upon combustion in a spent liquor recovery furnace, will increase the effective capacity thereof. This increase in the effective furnace capacity is accomplished due to the following factors:

(a) The heating value of the OCSL has been significantly reduced;

(b) In spite of the above heating value reduction, the OCSL is capable of supporting combustion in the recovery furnace without the addition of auxiliary fuel; and (c) The viscosity of the OCSL is comparable to the viscosity of unoxidized SSL which has been concentrated to the same total solids level.

In a preferred process of the present invention, for application to a continuous recovery system, SSL as initially evaporated is divided into respective first and second strong pulping liquor streams. Next, only the first strong spent liquor stream is partially oxidized and evaporated. The partially-oxidized, evaporated liquor is then added to the unoxidized SSL prior, during, or subsequent to concentration. Thus, by conducting the partial oxidation in this manner, without oxidizing either the entire weak or strong spent liquor streams, the aforementioned problems of multiple-effect evaporator fouling as well as formation of a non-flowable highly-viscous liquor are avoided. Oxygen, or a mixture of same and an inert gas, is employed for this purpose.

Contrary to the prior art processes dealing with mild spent liquor oxidation to thiosulfate, the oxidation step of the subject process is carried out well beyond thiosulfate formation to the point where a substantial amount of the organic material is partially oxidized. The partial oxidation reaction is carried out to a degree so that the heating value of the partially-oxidized spent liquor is substantially less than the heating value of the unoxidized counterpart strong or concentrated spent liquor stream to which it is added. Desirably, this partial oxidation is adjusted to the point where the liquor viscosity is such that the liquor does not become nonpumpable.

The partially oxidized spent liquor is added (a) to the unoxidized second strong spent liquor and then concentrated, or (b) to the unoxidized concentrated strong spent liquor per se. In either case, a novel partially oxidized, concentrated spent pulping liquor is formed which has a high total solids, is flowable, and has a heating value which is capable of supporting combustion in a spent liquor furnace without the addition of supplementary heating fuel, as required by certain prior art recovery processes. Since the heating value of this partially-oxidized concentrated liquor is substantially reduced, the total heat released in the recovery furnace per unit of pulp production will also be reduced, and the effective capacity of the furnace will be significantly increased.

In carrying out a further aspect of the present invention, weak spent liquor may be added to the unoxidized strong spent liquor prior to partial oxidation.

DETAILED DESCRIPTION OF THE DRAWINGS

DETAILED DESCRIPTION OF THE INVENTION

Figure 2:
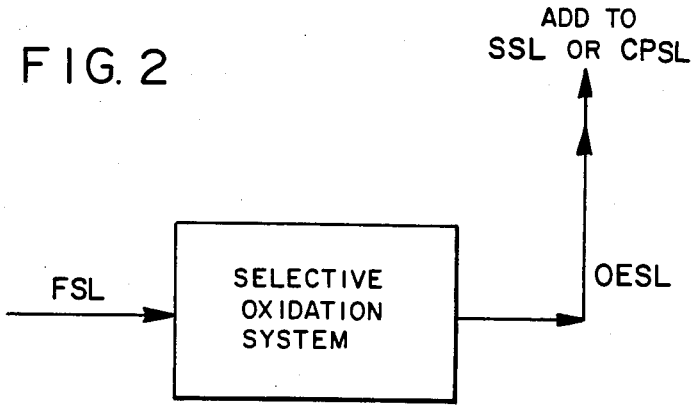
FIG. 2 is a schematic representation of the selective oxidation system of the present invention in which spent pulping liquor is partially oxidized.

Referring first to FIG. 2, a selective oxidation system is schematically depicted for forming a partially oxidized-evaporated spent pulping liquor (OESL) which when added to strong spent pulping liquor, prior or subsequent to concentration thereof, forms a novel combustible, high total solids, partially-oxidized concentrated spent pulping liquor (OSCL).

The spent pulping liquor which is partially oxidized and evaporated in the selective oxidation system is defined as the feed spent pulping liquor (FSL). The total solids of the FSL is generally from about 15 weight percent up to about 45 weight percent depending on the desired total solids of the OESL. When the OESL is to be added, without subsequent concentration, to the unoxidized concentrated product spent pumping liquor (CPSL), the total solids of the FSL is preferably from about 30 weight percent, up to about 45 weight percent. Alternatively, if the OESL is to added to the unoxidized SSL prior to concentration, the total solids of the FSL is preferably from about 15 weight percent and up to about 30 weight percent.

The FSL is an unoxidized spent pulping liquor such as weak spent liquor, strong spent liquor, diluted concentrated product spent liquor, or mixtures thereof. The selective oxidation system described in FIG. 2 was demonstrated by introducing a 48.67% total solids feed spent pulping liquor to a Stirred Parr reactor. The feed liquor had a gross heating value of 6,244 BTUs per pound of S. L. solids and a pH of about 13. The feed liquor was oxidized for one hour with molecular oxygen at a temperature of about 360 degrees to 380 degrees F. and a pressure of 260 psig. The partially-oxidized product was formed having a 55.63% total solids, a gross heating value of 4,595 BTU/pound of S. L. solids and a pH of 10. The reduction in gross heating value was about 36%.

The partial oxidation reaction is conducted in a closed system in which spent pulping liquor is contacted with oxygen, or with a mixture of oxygen and an inert gas. The pulping liquor is oxidized so that its heating value is significantly reduced while as much $CO_2$ as possible is removed from the system. Typically, the heat of reaction evolved during selective oxidation is sufficient to provide a temperature sufficient to produce OESL at the requisite reduced heating value level. In fact, in most cases, a portion of the heat of reaction is removed as steam in order to maintain a controlled reaction temperature. The partially oxidized spent liquor on exiting the closed reaction system enters an area of lower temperature and pressure prior to, or during, addition to the SSL or CPSL, where it is flashed and thereby evaporated to a higher total solids.

A typical illustrative partial oxidation sequence is conducted under the following conditions: A temperature of greater than about 150 degrees centigrade, and preferably from about 175 degrees centigrade up to about 270 degrees centigrade, a partial oxygen pressure, at the above reaction temperature, of from about 50 psi up to about 500 psi, and a residence time sufficient to produce the requisite OESL product. Exemplary equipment for carrying out selective oxidation are a tubular flow reactor or a back mix reactor. In the tubular flow reactor, for instance, the pulping liquor is pumped upwardly through the closed reactor and is contacted with the oxidizing gas which is added to the liquor using a sparge or other gas phase distribution means. Non-condensable gases and steam are removed overhead from the vapor space and the partially oxidized liquor is routed for addition to either strong or concentrated spent pulping liquor. A back mix reactor may be similarly employed.

There are two important factors governing the degree of partial oxidation to form the OESL in accordance with the invention. These are the extent of heating value reduction and the viscosity of the resultant OESL. The object of the partial oxidation is to reduce the heating value of the OESL (and thus the resultant OCSL) to an appropriate extent, as will be described in more detail below. However, in accordance with this invention, the resultant OESL will have a viscosity which is sufficiently low such that it will be flowable and blendable with the spent liquor to which it is added.

The degree of partial oxidation needed to produce the requisite heating value reduction will depend on the type of recovery furnace in use and the spent liquor firing mode employed. To support combustion of the spent liquor without adding heating fuel to the furnace requires a high total solids (typically 65%–75% by weight) concentrated spent pulping liquor having a minimum heating value of about 3,400 BTUs/pound of total spent pulping liquor. The present invention is carried out to such a minimum heating value, and in any event, it will be sufficiently high to support combustion without auxiliary fuel.

To achieve a minimum heating value, the degree of partial oxidation (and subsequent lower heating value) and the resultant amount of OESL added to the unoxidized SSL or CPSL are adjusted in relation to each other in order to achieve at least the minimum heating value. Expressed in another way, partial oxidation is continued prior to the point that the amount of OESL added to the SSL or CPSL will reduce the heating value of OESL-SSL/CPSL blend below the minimum heating value required for liquor combustion.

The unoxidized SSL and CPSL, to which the OESL is added, in general, have a heating value of from about 5,500 to 6,800 BTUs per pound of spent liquor solids. The heating value of alkaline strong or concentrated spent pulping liquor is from about 5,800 to about 6,200 BTUs per pound of spent pulping liquor solids. The gross heating value, for purposes of this invention, is determined according to ANSI/ASTM D2015-66 (revision 1978).

The heating value of the OESL is substantially less than the heating value of the unoxidized strong or concentrated spent pulping liquor (SSL or CPSL) to which it is added, but high enough so that the OCSL formed therefrom is capable of supporting combustion in a spent pulping liquor recovery furnace without requiring the addition of auxiliary fuel. The amount of OESL added is adjusted depending on its heating value and total solids.

As for extent of the gross heating value reduction of the OESL, typically, the gross heating value of the OESL is at least about 20 percent less than the gross heating value of the unoxidized spent pulping liquor, SSL or CPSL, to which it is added. Preferably, the heating value of the OESL is at least 30 percent less, and in the most preferable form at least about 50 percent less, than the unoxidized spent pulping liquor.

The viscosity of the OESL should be adjusted during the subject partial oxidation step so that it is not increased beyond the point where the OESL will not be flowable. The viscosity of the OESL should be at a level which will enhance blendability of the OESL with the OCSL or CPSL to which it is subsequently added. It is desirable that the viscosity of the OESL is substantially the same as, or less than, the viscosity of the unoxidized liquor, SSL or CPSL, to which it is added. This viscosity can vary depending on whether or not the OESL is to be subsequently concentrated. In the case where there will be no subsequent concentration (see FIG. 3, method "C"), a viscosity comparable to the hereinafter viscosity for the CPSL can be provided. On the other hand, if subsequent concentration is in order, the viscosity must be maintained at a level which will facilitate the formation of an OCSL product. In this latter case, a viscosity substantially lower than for CPSL must therefore be established. For example, representative viscosity for the OESL used in methods "A" and "B" of FIG. 3 would be one which is compatible with the unoxidized SSL to which it is added.

The viscosity of a given spent liquor, for purposes of this invention, is measured using a Brookfield rotational viscometer, model LV or RV, manufactured by the Brookfield Engineering Laboratories, Inc., of Stoughton, Mass. The viscosity is determined at a shear rate range of about 5 to 25 reciprocal seconds and a temperature of 180 degrees F. At a total solids of about 50%, the SSL viscosity is typically less than about 100 centipoises, and for the most part is less than about 70 centipoises. SSL from alkaline pulping operations by and large has a viscosity of from about 50 centipoises up to about 70 centipoises.

While not preferred because it is less amenable to a continuous recovery process (rather than batch), OESL may also be formed by oxidizing an unoxidized concentrated spent pulping liquor to a point where it is not flowable, and then diluting the nonflowable spent liquor with water or spent pulping liquor to restore flowability. The following is an example of same: A concentrated-oxidized strong spent pulping liquor of about 62% by weight total solids and a gross heating value of 4,654 BTUs per pound of spent liquor solids was formed and was added in a 2:1 weight ratio to an unoxidized strong spent pulping liquor having about a 47% total solids and a gross heating value of about 6,244 BTUs per pound of spent liquor solids. The combined liquor was concentrated to form a pumpable, flowable, concentrated, partially-oxidized, high total solids spent pulping liquor having about a 75% total solids and a gross heating value of about 5,176 BTUs/pound of dry liquor solids, a percent of heating value reduction of about 21%. This OCSL product is readily combustible in a spent pulping liquor recovery furnace without the addition of auxiliary heating fuel.

The 62% total solids, 4,654 BTU/pound S. L. solids concentrated-oxidized spent liquor was prepared as follows: a 65% total solids, 6,392 BTU/pound S. L. solids heating value, concentrated product spent pulping liquor to which was added 1% NaOH by weight on S. L. solids and oxidized with molecular oxygen in a Parr reactor at a temperature and pressure of up to about 513 degrees F. and 1,000 psi for a time period of about eight minutes. Five hundred twenty grams of this first oxidized solid material was diluted with 250 ml of water and evaporated to drive off $CO_2$ and to minimize bicarbonate formation. The 520 grams degassed product was combined with 25 grams of strong spent pulping liquor containing 0.12 grams NaOH and the total mixture oxidized with molecular oxygen for about 9 minutes in a Parr reactor. The reactor temperature and pressure reached a maximum of 430 F. and 1,000 psi. The second oxidized product had a value of 4,654 BTUs/pound S. L. solids. After diluting the second oxidized product to a 50% total solids, it was concentrated to 62% total solids to again remove $CO_2$ and minimize the bicarbonate.

In carrying out the partial oxidation of this invention, it is important that the amount of bicarbonate present during the course of the reaction be minimized. By removing (venting) from the selective oxidation system the $CO_2$ gas generated during partial oxidation, as previously described, bicarbonate formation will be limited. The reduction in the amount of bicarbonate to a minimum level expedites the subsequent blending of the OESL produced with either the SSL or the CPSL, respectively, to which it is added. The presence of bicarbonate material interferes with the partial oxidation process because it reduces the pH of the OESL. The rate of alkaline oxidation decreases with decreased pH. During the partial oxidation process bicarbonate formation is reduced by removing as much $CO_2$ gas generated therein as possible. It is desirable that the pH of the OESL is at least about 10, preferably at least about 10.5, and most preferably at least about 11 in order to insure this minimum bicarbonate level.

Figure 3:
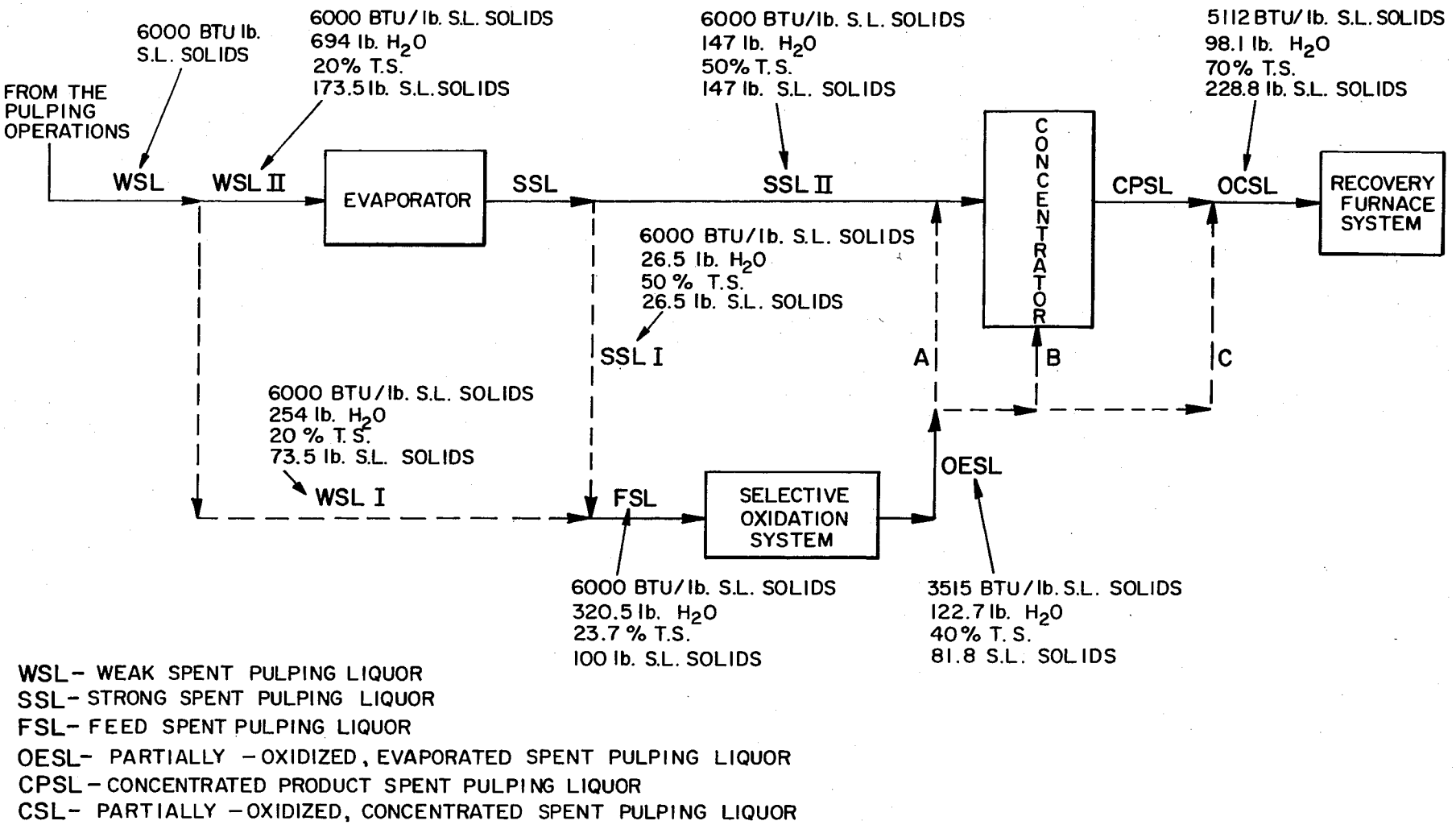
FIG. 3 is a schematic representation of a preferred spent liquor recovery process of the subject invention including the selective oxidation system of FIG. 2.

In connection with conventional spent liquor recovery operations, several optional procedures regarding concentrating and blending of partially-oxidized spent pulping liquor and unoxidized SSL and CPSL are schematically depicted in FIG. 3.

The total solids of the OESL formed by the selective oxidation system will vary depending on the method subsequently employed for producing OCSL. These methods are shown as "A", "B" and "C" in FIG. 3. Generally, the OESL total solids can vary from about 35 weight percent up to about 75 weight percent depending on the amount of OESL added to the strong or concentrated spent liquor. For direct use without further concentration, as depicted in method "C" of FIG. 3, a total solids of about 65–75 weight percent is preferred for the OESL. On the other hand, if the OESL is to be further concentrated, after being added to the SSL stream, the preferred total solids is about 35–45 weight percent (see methods "A" and "B" of FIG. 3). For purposes of this invention, total solids is measured employing TAPPI T-625 ts-64.

When OESL is added to either SSL or CPSL by any other methods "A", "B" or "C", a partially-oxidized, concentrated, high total solids spent pulp liquor product (OCSL) is formed having a substantially lower heating value than the SSL or CPSL to which it was added. The OCSL is capable of supporting combustion in a recovery furnace without requiring the addition of auxiliary fuel. When combusted in the recovery furnace, the effective capacity thereof is significantly increased as compared to the effective capacity for conventional combustion of CPSL per se. In a typical case, the above effective capacity will be increased at least about 10%, although increases of at least about 15%, and even at least about 20% can be effected.

For example, a 20% increase in the effective capacity of a recovery furnace for a 1,000 ton/day pulp and paper production facility would provide a daily net increase of 200 tons of pulp. At a net added value of $100 per ton of pulp, a mill operating for 360 days a year would reap additional profit of $7,200,000.

The heating value of the OCSL is at least about 10% and preferably at least about 15%, and most preferably at least about 20%, less than the unoxidized spent pulping liquor, either SSL or CPSL, but high enough to support combustion in a spent liquor recovery furnace without requiring the addition of auxiliary heating fuel. At the same time, the viscosity of the OCSL has not been significantly decreased, but is substantially the same as the unoxidized CPSL. In general the viscosity of the OCSL is maintained at not greater than about 1,200 centipoises or less, and preferably from about 300 up to about 1,000 centipoises at a total solids level of about 70 percent.

Figure 1:
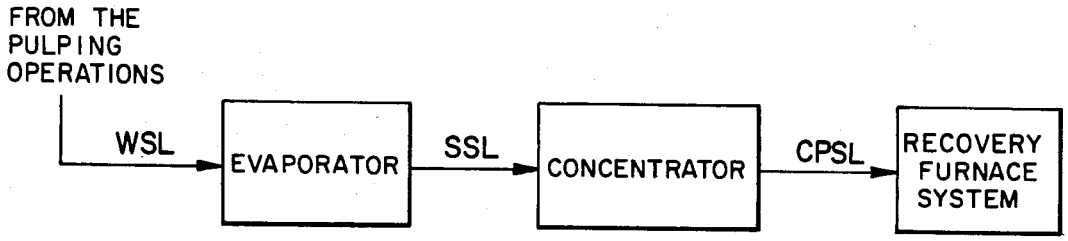
FIG. 1 PRIOR ART
FIG. 1 is a schematic representation of a conventional spent pulping liquor recovery system.

The furnace recovery system depicted in FIG. 1, normally includes a provision for adding a mixture of combusted recycle ash from the furnace and make-up chemicals such as sodium sulfide to the OCSL prior to furnace combustion. This OCSL mixture is defined to be "as-fired spent pulping liquor."

A preferred process of the present invention for producing OCSL is schematically depicted in FIG. 3. More specifically, weak spent pulping liquor stream (WSL) from a commercial pulping operation is provided, typically at a total solids of up to about 25% by weight, although in some cases the WSL total solids is up to about 20% by weight. Alkaline spent pulping liquors, such as kraft and soda pulping liquor, are generally at a total of about 15–20 weight percent.

The pH of the WSL from alkaline pulping operations, as well as the subsequently formed SSL, FSL, and CPSL, respectively, is quite high, generally 12 or more, and usually about 13 or higher.

WSL can, in its entirety, be transported directly to the Evaporator for initial evaporation of same to a strong spent pulping liquor (SSL). Alternatively, however, the WSL can be divided into respective first and second weak spent pulping liquor streams (WSL I and WSL II). The amount of WSL apportioned between WSL I and WSL II, respectively, is set depending on the spent pulping liquor properties desired, particularly the total solids, of the spent pulping liquor feed stream supplied to the hereinafter described Selective Oxidation System.

WSL II is fed directly to the Evaporator and SSL is formed. This initial WSL evaporation step can be conducted employing various types of conventional evaporation equipment well known in the pulp and paper business. For the most part, the SSL produced in the Evaporator has substantially the same gross heating value and pH as WSL. However, the total solids of the SSL is increased to preferably at about 40 weight percent, up to about 55 weight percent. Illustrative of the evaporation equipment which can be used herein is a multi-stage evaporator, such as a standard multi-effect evaporator prevalent throughout the pulp and paper industry.

The unoxidized SSL exiting the Evaporator is then divided into respective first and second unoxidized strong spent pulping liquor streams (SSL I and SSL II). SSL II is transferred to the hereinafter described Concentrator, while SSL I is diverted to the Selective Oxidation System. SSL I, along with whatever weak spent pulping liquor has been segregated as WSL I, is employed to form the unoxidized feed spent pulping liquor stream (FSL) which is partially oxidized and further evaporated by the Selective Oxidation System. The gross heating value and pH of the FSL is similar to that of both the WSL and SSL. The total solids of the FSL are also adjusted to conform to the specific total solids requirements for the spent liquor product to be formed in the subsequent selective oxidation-evaporation and concentration operations, respectively, as previously described.

FIG. 3 also includes an illustrative material and energy balance for a preferred embodiment of the present invention in which the respective WSL and SSL streams are divided, and the WSL I and SSL I streams recombined as FSL. It is noted that, according to this illustration, the heating value of the spent liquor would be lowered by about 41%, from 6,000 BTU/pound S. L. solids to 3,515 BTU/pound S. L. solids, and the total solids measured from 23.7% to 40%, respectively. The OCSL formed from the combined OESL and SSL II streams would be a flowable liquid at a 70% total solids and would have a heating value of 5,112 BTU per pound of S. L. solids which is clearly cumbustible in a recovery furnace. Finally, a 14.7% increase in the effective capacity of the furnace would result.

We claim the following:

1. A process for increasing the capacity of a spent pulping liquor recovery furnace, which comprises:

(a) forming an unoxidized strong spent pulping liquor stream and dividing the stream into first and second unoxidized strong spent pulping liquor streams;

(b) partially-oxidizing and evaporating said first strong spent pulping liquor stream, said partial-oxidation step being conducted employing oxygen, or a mixture of oxygen and an inert gas, so that the amount of bicarbonate material produced during said partial-oxidation is minimized, a partially-oxidized spent pulping liquor being produced having an increased total solids, and a gross heating value which is at least twenty percent less than the gross heating value of said second unoxidized strong spent pulping liquor stream without significantly increasing the viscosity thereof;

(c) adding said partially oxidized evaporated spent pulping liquor either to the second stream and then concentrating the mixture, or to the second stream after the second stream has been concentrated to form a partially-oxidized, concentrated, high total solids spent pulping liquor product having a substantially lower gross heating value than, but a substantially similar viscosity as, said second unoxidized spent pulping liquor stream, said heating value being at least about 3400 BTUs/pound of liquor, said product, upon combustion in said furnace, significantly increasing the effective capacity thereof.

2. The process of claim 1, wherein said unoxidized strong spent pulping liquor stream is formed by initially evaporating a stream of unoxidized weak pulping liquor.

3. The process of claim 2, wherein said weak unoxidized spent pulping liquor is divided into respective first and second weak spent pulping liquor streams, prior to said initial evaporation step, said first liquor stream being subjected to said initial evaporation step, and second weak liquor stream being subsequently combined with said first strong spent liquor stream, prior to said partial-oxidation step, and the combined spent pulping liquor stream being subjected to said partial oxidation step.

4. The process of claim 1, wherein said second unoxidized strong spent pulping liquor stream is first concentrated, and is thereafter combined with said partially-oxidized spent pulping liquor stream.

5. The process of claim 1, wherein the pH of the partially-oxidized spent pulping liquor is at least about 10.

6. The process of claim 1, wherein the increase in the effective capacity of said recovery furnace is at least about 10%.

7. The process of claim 1, wherein the viscosity of the partially-oxidized, evaporated spent pulping liquor is substantially the same as, or less than, the viscosity of the unoxidized spent liquor to which it is added.

8. The process of claim 1, wherein the gross heating value of said partially-oxidized, evaporated liquor is at least about 50 percent less than the gross heating value of the unoxidized liquor to which it is added.

9. The process of claim 1, wherein the total solids of said partially-oxidized, concentrated liquor is from about 65 weight percent up to about 75 weight percent.

10. The process of claim 1, and wherein the partial-oxidation is carried out in a closed system and the formation of bicarbonate is minimized in the partial-oxidation step by the removal of carbon dioxide from said system.

* * * * *